US005868816A

United States Patent [19]

Michard et al.

[11] Patent Number: 5,868,816

[45] Date of Patent: Feb. 9, 1999

[54] PROCESS FOR ADJUSTING THE COMPOSITION OF A LIQUID METAL SUCH AS STEEL, AND PLANT FOR ITS IMPLEMENTATION

[75] Inventors: Jean Alex Michard, Ville D'Avray; Henri Gaye; Jean-Luc Roth, both of Metz, all of France

[73] Assignee: Sollac (Societe Anonyme), Puteaux, France

[21] Appl. No.: 612,834

[22] PCT Filed: Oct. 5, 1994

[86] PCT No.: PCT/FR94/01161

§ 371 Date: May 20, 1996

§ 102(e) Date: May 20, 1996

[87] PCT Pub. No.: WO95/10377

PCT Pub. Date: Apr. 20, 1995

[30] Foreign Application Priority Data

Oct. 15, 1993 [FR] France ..... 93/2469

[51] Int. Cl.[6] ..... C21C 7/10

[52] U.S. Cl. ..... 75/511; 75/705; 75/957; 266/209

[58] Field of Search ..... 75/510, 511, 705, 75/957; 266/209

[56] References Cited

U.S. PATENT DOCUMENTS 3,321,300 5/1967 Worner ..... 75/511
3,367,396 2/1968 Sickbert et al. ..... 266/209
3,901,305 8/1975 Balevski et al. .

FOREIGN PATENT DOCUMENTS 0135050 3/1985 European Pat. Off. .
1268790 5/1968 Germany .
1807846 7/1970 Germany .
4131316 5/1992 Japan .
380885 10/1964 Switzerland .

*Primary Examiner*—Melvyn Andrews
*Attorney, Agent, or Firm*—Sixbey Friedman Leedom & Ferguson; Thomas W. Cole

[57] ABSTRACT

A process for adjusting the composition of a liquid metal, such as steel, is provided wherein liquid metal is sucked up from a start receptacle into a reactor which is at a reduced pressure with respect to the start receptacle. First, the liquid metal is made to flow inside the reactor under conditions close to plug flow where it undergoes a metallurgical treatment. Next, after the liquid metal has been conveyed through the reactor it is completely discharged into a finish receptacle which is also at a reduced pressure with respect to the reactor. To insure thorough mixing, the reactor is divided into a plurality of cells, each of which has its own independent gas injector for agitating the liquid metal therein.

19 Claims, 2 Drawing Sheets

PROCESS FOR ADJUSTING THE COMPOSITION OF A LIQUID METAL SUCH AS STEEL, AND PLANT FOR ITS IMPLEMENTATION

BACKGROUND OF THE INVENTION

The invention relates to the smelting of liquid steel. It applies particularly to the smelting of high-purity steels having extremely low contents of carbon, or indeed also of nitrogen and of oxygen.

The use of vacuum reactors of the type called "RH" is commonplace nowadays in the smelting of liquid steel. It will be recalled that these reactors are composed:

- of a tall vessel having a roughly cylindrical shape and internally lined with refractories, the upper part of which vessel is connected to a gas-sucking device capable of maintaining in this vessel a reduced pressure which may go down to at least 1 torr when the reactor is operating;
- of two pipes or dip tubes, having a cylindrical or oval cross section, which are internally and externally lined with refractories, one of the ends of which emerges in the bottom of the vessel; one of these dip tubes is furnished with a device enabling a gas, usually argon, to be blown thereinto.

These plants are used as follows. The ladle containing the liquid metal to be treated is brought under the RH and the lower ends of the dip tubes are immersed thereinto. After this, a vacuum is created in the vessel, which causes a certain quantity of metal inside it to be sucked out. Finally, the blowing of gas into the dip tube equipped for this purpose commences. The function of this blowing is to drive the metal lying in this dip tube toward the vessel, and for this reason this dip tube is called "ascending dip tube". The metal travelling through the vessel next redescends into the ladle using the other dip tube, called "descending dip tube". A continuous circulation of metal between the ladle and the vessel is thus obtained. Throughout the duration of the treatment (namely, in general, from about ten to about thirty minutes), any one same drop of metal therefore resides a number of times within the vessel. The average duration of these is a function of the flow rate of the metal in the dip tubes and of the ratio between the respective volumes of the ladle and the vessel. Passing the liquid metal into the vessel maintained under vacuum principally makes it possible to decrease its contents of dissolved hydrogen and, to a lesser extent, of dissolved nitrogen. The other metallurgical operations which may occur in the vessel are:

- partial decarburization, by carbon combining with the oxygen which is already dissolved in the metal or which is blown into it for this purpose via a lance or tuyeres inserted into the wall of the vessel;
- addition of alloying elements which is thus carried out protected from the air and from the ladle slag, and therefore with optimum efficiency;
- reheating of the metal by aluminothermy: aluminum is added to the metal, then oxygen is blown thereinto and the resulting oxidation of the aluminum causes this reheating.

At the same time, the circulation of metal between the ladle and the vessel causes gentle agitation of the metal in the ladle, this being favorable to proper settling-out of the nonmetallic inclusions.

In recent years, there has been an increasing demand from steel-consuming industries for ferrometallurgical products having an extremely low carbon content (less than 50 ppm), in particular for cold-rolled sheet having high ductility and high tensile strength, for deep-drawing steels, for chrome-molybdenum ferritic stainless steels, etc. It has quickly become apparent that the RH is the in-ladle metallurgy reactor best suited to obtaining such steels under industrial conditions. In fact, the decarburization kinetics therein is favorably influenced by the massive injection of gas through the ascending dip tube, or even also into the vessel. Thus, for a ladle containing 300 t of liquid steel, an RH vessel containing 15 t of it and a flow rate of 240 t/min, a treatment time of 10 minutes may suffice to lower the carbon content in the steel from 300 ppm to 20 ppm.

The increase in demand for steels of greater and greater purity will, in the very near future, probably make it necessary to be able to obtain routinely even lower carbon contents (from 5 to 10 ppm) with a productivity at least equivalent to that of current plants (approximately 10 t/min in large integrated factories). Now, in conventional RHs, a distinct slowing down of the decarburization kinetics is observed when the average carbon content of the liquid steel becomes less than 30 ppm. Substantially speeding up said kinetics would allow the desired metallurgical performance to be obtained in a time which is still compatible with optimum running of the other steelmaking units. However, this would be conceivable only by considerably increasing the flow rate of the metal and the amount of gas blown in. The result would be an excessively accelerated wear of the refractories, and therefore more frequent stoppages and less reliable operation of the plant. In short, it seems to be beyond the scope of an RH of conventional design to obtain, at an industrial rate, carbon contents substantially less than 10 ppm under satisfactory technical and economic conditions.

It is all the more important to obtain as low a carbon content in the liquid steel as possible, since the steel will have many opportunities to recarburize during the subsequent production and casting operations for example by coming into contact with the refractories and cover powders of both the tundish and the mold.

The object of the invention is to propose a novel type of metallurgical reactor which allows the carbon contents in the liquid steel to approach the order of 10 ppm and less under satisfactory productivity conditions This reactor should also be able to be used to produce steels which are less deeply decarburized but have a very low content of oxidized inclusions.

SUMMARY OF THE INVENTION

The subject of the invention is a process for adjusting the composition of a liquid metal, wherein said liquid metal is sucked up from a start receptacle into a reactor which is at a reduced pressure with respect to said first receptacle, said metal is made to flow inside said reactor under conditions close to plug flow and it is made to undergo a metallurgical treatment and wherein, after it has been conveyed through said reactor, said metal is discharged into a finish receptacle with respect to which said reactor is also at a reduced pressure.

Preferably, said start receptacle is fed continuously with metal and said metal is also made to flow continuously from said finish receptacle.

In one example of implementation of the process, the liquid metal is steel, the metallurgical treatment includes decarburization, denitriding or a vacuum deoxidation using carbon, and the finish receptacle is a continuous casting tundish.

The subject of the invention is also a plant for adjusting the composition of a liquid metal, such as steel, which includes a start receptacle containing said liquid metal, a reactor and a finish receptacle, said reactor including a vessel provided with means enabling its interior to be maintained at a reduced pressure with respect to those pressures existing in said start receptacle and said finish receptacle, with a first dip tube called ascending dip tube, one end of which dips into the liquid metal contained in said start receptacle and the other end of which is connected to the bottom of said vessel, with a second dip tube called descending dip tube, one end of which dips into the liquid metal contained in said finish receptacle and the other end of which is connected to the bottom of said vessel, and with means for ensuring continuous flow of said liquid metal between said start receptacle and said finish receptacle through said dip tubes and said vessel of the reactor, and wherein said vessel is shaped so as to impose on said liquid metal a flow close to plug-type flow over its travel between said dip tubes.

This plant may, according to the invention, be inserted into a plant for adjusting the composition of the liquid steel, including:

an apparatus for the primary smelting of the liquid steel;

means for continuously pouring said liquid steel from the primary smelting apparatus into a first receptacle provided with means for introducing deoxidizing agents into the liquid metal and with mixing means;

a reactor for the rough decarburization of the liquid metal, including a vessel provided with means for putting it at a reduced pressure, with a first dip tube dipping into the liquid metal contained in said first receptacle and with a second dip tube dipping into an intermediate receptacle, said vessel also including means for blowing oxygen into said liquid metal;

means for ensuring continuous flow of said liquid metal between said first receptacle and said intermediate receptacle; and at least one plant for adjusting the composition of the liquid steel of the type which has just been described, for which said intermediate receptacle forms said start receptacle.

As will be understood, the proposed novel reactor has points in common with the RH, namely the presence of a vessel placed under vacuum and of two dip tubes, via which the metal penetrates into the vessel and leaves therefrom. However, the principle of continuous circulation of the liquid metal between the ladle and the reactor is abandoned: the metal leaving the reactor is, in this case, poured into a receptacle other than its start receptacle and will no longer come back into this same reactor. In addition, whereas the RH behaved as a thoroughly mixed reactor, the liquid steel in the reactor according to the invention must exhibit a flow close to plug flow. As required, as will be seen, this pseudo-plug flow is obtained by virtue of breaking up the reactor into a multiplicity of thoroughly mixed cells between which exchanges of material are reduced to a minimum.

Finally, this reactor may advantageously be inserted into a continuous or semicontinuous liquid steel production line.

The invention will be better understood on reading the description which follows, given with reference to the following appended figures:

BRIEF DESCRIPTION OF THE SEVERAL FIGURES

DETAILED DESCRIPTION OF THE PREFERRED EMBODIMENT

Figure 1:
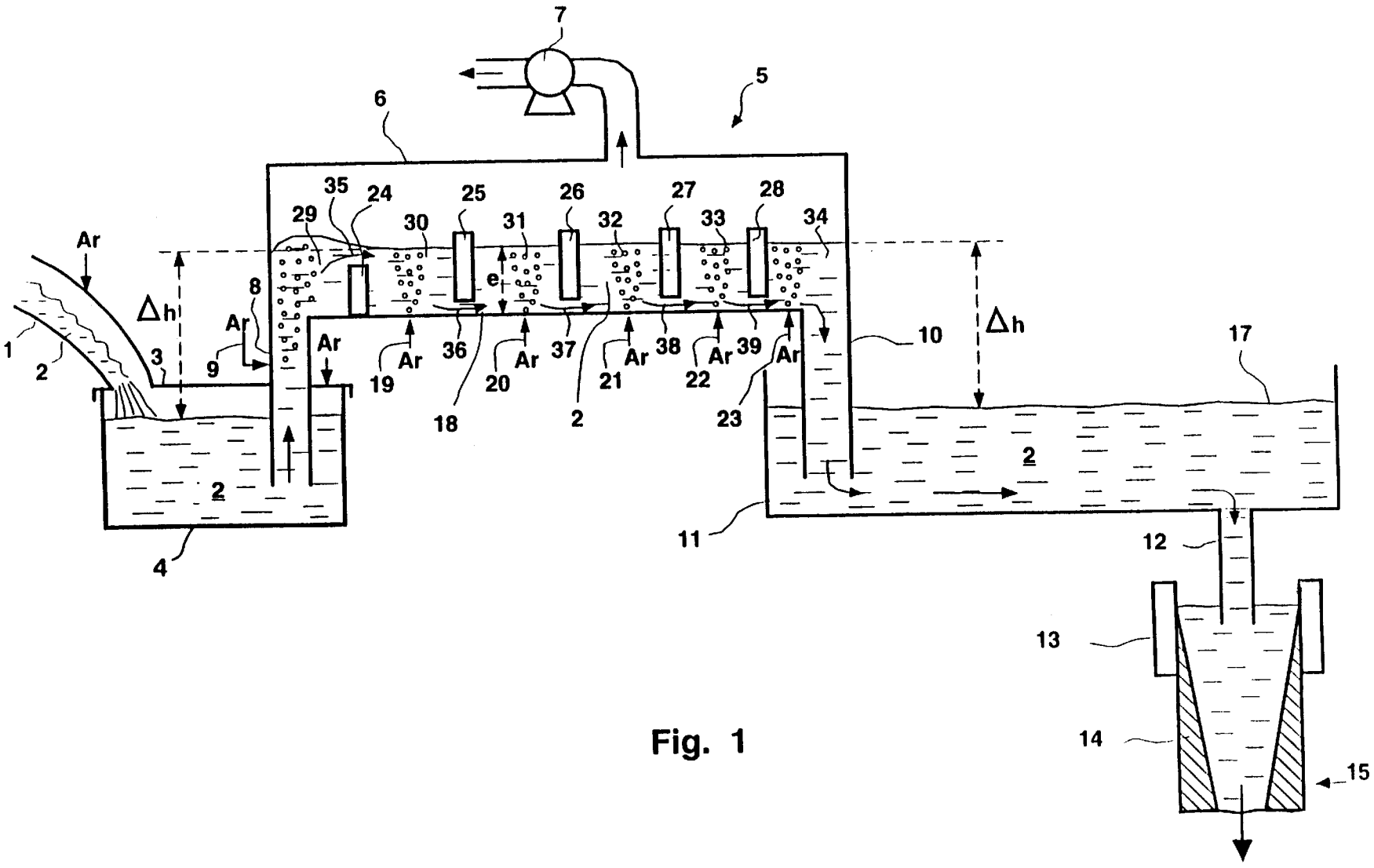
FIG. 1 shows diagrammatically, seen in longitudinal section, an example of a metallurgical reactor according to the invention.

It seems to the inventors that one of the reasons why very high decarburization is not achievable sufficiently rapidly in an RH is, in fact, that a given elementary portion of liquid metal is exposed to the vacuum therein only for a relatively short mean time. Again taking the example, given earlier, of an RH having a capacity of 15 t of liquid metal coupled to a 300 t ladle with a flow of 240 t/min, the mean residence time of a portion of the metal in the RH vessel is only 30 seconds for 10 minutes of treatment. Most of these 30 seconds is taken up by the first stages of decarburization, which allow the content to go relatively easily from 200–400 ppm to 30 ppm. Thereafter, there is no longer enough time left to complete the decarburization, down to 10 ppm levels or less, in a manner compatible with the production rates of the other steelmaking units (converter or electric furnace, and continuous casting).

Moreover, the principle of continuous recirculation of the metal between the ladle and the vessel means that the latter is constantly fed with metal which is less decarburized than the metal already there and undergoing decarburization. Since the vessel behaves as a thoroughly mixed reactor, it is possible to define at any instant a mean carbon content $C_V$ of the metal in the vessel and likewise a mean carbon content $C_L$ of the metal in the ladle. As $C_L$ is always greater than $C_V$, it is understood that the decrease in $C_V$ is slowed down by the influx of less decarburized metal of carbon content $C_L$. This is well expressed by the mathematical models of decarburization which involve the ratio $C_V/C_L$, in the expression for the kinetics coefficient of the reaction. In order to obtain rapid decarburization, the ratio $C_V/C_L$ must be as close as possible to 1. In conventional RHs, it is of the order of 0.6 on average and varies as a function of the stage of progress of the decarburization and of the rate of recirculation of the metal.

This condition of $C_V/C_L$ is ideally met if all the metal to be treated is exposed to vacuum at the same time; this corresponds to the case of a conventional plant with vacuum in the ladle. But if this type of plant is used, one of the fundamental advantages of the RH is lost, namely the possibility of speeding up the decarburization kinetics by passing considerable quantities of gas into the metal, where they are added to the mass of metal involved. To pass these quantities of gas into a simple vacuum ladle would cause excessive splashes of metal which would very rapidly damage the plant. Another advantage of the RH is to expose to vacuum a surface area of metal which is large compared to the volume contained in the vessel, but this advantage no longer exists if a vacuum ladle is used. Thus, simple vacuum ladles or vacuum furnace-ladles are only rarely used in industrial practice to obtain carbon contents of less than 40 ppm, since overall the decarburization in them is not sufficiently rapid.

Another way of approaching the ideal condition of $C_V/C_L$ would be to increase the rate of recirculation of the metal between the ladle and the vessel by changing the geometry of the dip tubes and the flow rate of gas blown into the ascending dip tube. However, this would considerably accelerate the wear of the refractories.

FIG. 1 represents diagrammatically the principle of an elementary reactor according to the invention and an example of it inserted into a plant for the continuous production of steel. This plant comprises a launder 1 which supplies liquid steel 2 flowing continuously with a controllable flow rate from a metallurgical receptacle, not shown, such as a steelmaking ladle or an apparatus for the primary smelting of the metal, similar to a converter or an electric furnace. This primary smelting apparatus also works continuously. This launder 1 is connected to a cover 3 which rests on an intermediate receptacle 4, exposed to atmospheric pressure, into which the liquid steel 2 flows. Optimally, an inert gas, such as argon, is injected into the launder 1 and under the cover 3 in order to protect the metal 2 from ambient air. It is from this liquid steel 2 that it is desired to strip as much as possible of the dissolved gases (hydrogen and nitrogen) contained in it, and also its carbon. For this purpose, the metallurgical reactor 5 according to the invention is used. As in conventional RH-type reactors, this reactor 5, which is internally lined with refractory, includes:

- a vessel 6 intended to contain, at a given instant, a certain quantity of flowing liquid steel 2; as in the RH vessels, this vessel 6 must be high enough for its upper part not to run the risk of being excessively damaged by splashes of liquid metal;
- a gas-sucking device 7 intended to establish a reduced pressure in the vessel 6;
- an ascending dip tube 8 passing through the cover 3 and dipping into the intermediate receptacle 4; it may be equipped with means 9 for injecting a gas such as argon, these being intended to cause or assist the flow of the liquid metal 2 through the vessel 6;
- a descending dip tube 10 via which the liquid metal leaves the vessel 6.

Unlike RHs, this descending dip tube 10 does not discharge into the same receptacle as the ascending dip tube 8 but into a finish receptacle 11 which, in the example shown, is a continuous casting tundish. As is necessary, this tundish 11 is equipped at least one outlet nozzle 12 by means of which the liquid metal 2 flows out continuously with a flow rate which can be controlled by a stopper rod or a slide valve, neither being shown, into at least one bottomless mold 13 having walls which are vigorously internally water-cooled. It is in this mold 13 that a skin 14 of steel starts to solidify, this skin giving rise to a ferrometallurgical product 15, a slab, bloom or billet depending on the shape and size of the mold 13.

RH vessels have a substantially cylindrical shape, with an internal diameter of a few meters at most. This configuration gives the RH properties of a thoroughly mixed reactor. In contrast, according to the invention, the vessel 6 must result in the reactor 5 having properties as close as possible to those of a plug flow reactor, in which the steel which has been degassed and/or decarburized down to given levels cannot then be mixed with a less purified steel. For this purpose, one solution consists in giving the interior of the vessel 6 the shape of a duct, that is to say of a channel having a long and narrow rectangular or approximately rectangular cross section, at the ends of which the dip tubes 8, 10 are connected. The ratio between the distance separating the dip tubes 8, 10 and the width of the channel is at least equal to 6. For example, the vessel 6 may have a width of from 1 m to 1.50 m and a length separating the dip tubes 8, 10 of from 8 to 10 m. The efficacy of the decarburization and the degassing is largely a function of the ratio between the surface area of liquid metal 2 exposed to vacuum and the volume of this same liquid metal 2 in the vessel 6. This ratio must be as high as possible, which means that, for a given volume of metal, the depth "e" of the metal in the vessel 6 must not be too great (for example from 0.40 to 0.80 m). This depth is governed by the geometry of the entire plant (in particular the differences in level between the vessel 6 and the intermediate receptacle 4 and the tundish 11) and also by the pressure difference ΔP between the interior of the vessel 6 and atmospheric pressure to which the surfaces 16 and 17 of the liquid steel 2, in the intermediate receptacle 4 and in the tundish 11 respectively, are exposed. Calling Δh the mean difference in level between the surface of the liquid steel 2 in the vessel 6 of the reactor and said surfaces 16, 17 exposed to atmospheric pressure, we have the relationship $$\Delta h = \frac{\Delta P}{\rho \cdot g}$$

where p is the density of the liquid steel (around 7000 $kg/m^3$) and g is the acceleration due to gravity (9.8 $m/s^2$), that is:

$$\Delta h \text{ (in m)} \approx 1.46 \cdot 10^{-5} \text{ AP (in Pa.)}.$$

Calling P the absolute pressure in the vessel 6 and assuming that the intermediate receptacle 4 and the tundish 11 are exposed to a pressure of 1 atm (that is 101 325 Pa), we therefore have:

$$\Delta h \approx 1.46 \cdot 10^{-5} \ (101325 - P)$$

Thus, if P is 50 torr then Δh≈1.40 m and if P is 1 torr then Δh≈1.50 m.

The depth e of the liquid metal 2 in the vessel 6 is therefore relatively independent, over the usual ranges of pressure, of the level of vacuum obtained in the vessel 6.

As stated previously, the flow of the metal between the receptacles 4, 11 through the reactor 5 is governed partly by the injection of gas into the ascending dip tube 8, if injection is made at this point. However, in all cases, the existence of this flow and the flow rate of metal which it entails depend on the difference in level between the surface 16 of the liquid metal 2 in the intermediate receptacle 4 and the surface 17 of the liquid metal 2 in the tundish 11. This difference in level is linked in particular to the difference between the rate of flow feeding the intermediate receptacle 4 and the rate of flow of metal 2 leaving the tundish 11.

The duct shape of the vessel 6 of the reactor 5 is more suited to establishing a plug-type flow in the liquid metal 2. However, the supply of metal coming from the ascending dip tube 8 and the releases of gas, possibly due to the argon injected into this dip tube 8 and the decarburization of the metal (at least in the zone upstream of the vessel 6 where this decarburization is most intense), cause strong agitation which can appreciably impair, and in an uncontrollable manner, the conditions for this flow. This is why it is advisable to achieve a flow approaching plug flow by dividing the vessel 6 of the reactor 5 into a series of thoroughly mixed cells, between which the exchanges of liquid metal 2 are also as limited as possible. For this purpose, devices 19–23 for injecting a fluid such as argon may be installed on the bottom 18 of the vessel 6, said devices being, for example, permeable elements or tuyeres, similar to those used in steelmaking converters, electric furnaces and ladles. These injection devices 19–23 ensure that the liquid metal 2 is vigorously mixed in their respective zones where they are installed. If the injection devices 19–23 are far enough apart from each other, these zones of influence may be considered as being sufficiently separate for communication between them to take place without any backdiffusion of liquid metal 2, from one cell back to another. Thus, within each cell, a homogeneous carbon concentration is obtained which is constant over time (insofar as the other operating conditions are constant), which situation corresponds to the ideal decarburization conditions predicted by the mathematical models. In addition, these injections of argon considerably speed up the decarburization kinetics.

Optimally, it is possible, as shown in FIG. 1, to provide a physical separation of the various cells by installing dams 24–28 in the vessel 6. These dams 24–28 are arranged transversely to the general orientation of the vessel 6 and delimit cells 29–34, each equipped with a fluid injection device 19–23 (except possibly for the first cell 29, if an injection of fluid is made into the ascending dip tube 8; it is then this injection which agitates the metal in this first cell 29). The first dam 24, that is to say the one separating the first cell 29 from the second cell 30, preferably starts from the bottom 18 of the vessel 6 and has a height such that its upper part makes a threshold 35 which the liquid metal 2 can cross as it progresses into the vessel 6. This configuration contributes in correctly controlling the flow rate of the flowing metal 2. Openings 36–39 are made in the other dams 25–28 in order to allow the minimum communication between the cells 30–34, ensuring that the liquid metal 2 progresses through the vessel 6. These openings 36–39 are preferably placed in the lower parts of the dams 25–28, in order to allow the vessel 6 to be completely drained. In this way, the respective zones of influence of the fluid injection devices 19–23 are well delimited, and it is possible to provide a large number of such devices without increasing the risk of excessive exchanges of metal between two adjacent cells. In this way, conditions for ideal plug flow are approached more closely than in the absence of such dams.

It is also conceivable that means for agitating the metal 2 using suitably oriented moving electromagnetic fields might substitute for, or possibly be added to, the gas injection devices. This thus constitutes another possibility of controlling the flow of the metal 2 which could even make it possible to do away with the dams 24–28 in order to delimit the cells 29–34 satisfactorily.

Moreover, the reactor 5 is provided with all the equipment (not shown) that might usually be encountered on RHs, namely: one or more television cameras enabling the operators to observe the surface of the liquid metal 2 in the vessel, one or more devices for taking samples of metal (it is advantageous to provide several of them, graded along the vessel 5 [sic] in order to monitor the change in composition of the metal during the vacuum treatment), one or more devices for introducing alloying elements, one or more devices for blowing in oxygen and one or more graphite resistors for preheating the refractories in the vessel 6. It is advantageous to install a device for blowing in oxygen (lance or tuyere) at least in the first cell 29. It is thus possible, when this is necessary, to increase the initial content of dissolved oxygen in the liquid metal 2 and to remove the possible deoxidizing elements (Al, Si) present in the metal which would prevent decarburization. It may also be advantageous to install one of them in the final cell 34, if this cell is also equipped with means for introducing aluminum into the liquid metal 2: it is then possible to achieve the final reheating of the metal using aluminothermy. However, this implies that the carbon content obtained just prior to the liquid metal 2 entering a final cell 34 is acceptable. In fact, the introduction of aluminum means that the dissolved oxygen is captured, in the form of alumina, and therefore that the decarburization reaction is finally stopped. This also means that it would be possible, in the rest of the production, to remove the alumina formed in this way within the metal 2.

As a variant, the fluid injected into the bottom 18 of the vessel 6 via at least some of the devices 19–23 may be, not argon, but a gas capable, in the first instance, of being partially dissolved in the liquid steel, and the removal of which, under the effect of the vacuum, tends to promote decarburization. This gas may be nitrogen or, especially, hydrogen. This being the case, of course, it is accepted that the content of this gas in the metal, over most of the vessel, is higher than with the usual practice of blowing in argon. However, since hydrogen is a relatively easy gas to remove from liquid steel, it is sufficient to inject argon in place of hydrogen into the final cell or all the final cells in order to have the hydrogen levels in the metal 2 which are usually encountered on leaving a vacuum reactor. As regards nitrogen, its removal from liquid metal is slower and runs the risk of not being complete: it would be better not to use it as mixing gas if very low nitrogen contents are desired in conjunction with the very low carbon contents.

It is also possible to use this reactor 5, not as a high decarburization reactor, but as a vacuum deoxidation reactor. For this purpose, once the carbon content has reached a level deemed to be sufficiently low (for example 80 ppm), carbon is added to the bath in solid or gas form (for example in the form of $CH_4$) at one or more points along the vessel 6 so that it combines with the dissolved oxygen and decreases its concentration. Such a method of deoxidation has the advantage that it makes it possible to save a large part of the aluminum usually used for deoxidizing the bath and, likewise, to avoid the massive formation of alumina inclusions which would subsequently have to be removed before casting the metal. It is thus possible to cast a steel which is to a great extent free of inclusions, which results in a very low oxygen content in the end product. This method may also be applied to the smelting of stainless steels for which the deoxidation using carbon may be a step prior to the massive addition of chromium.

Another advantage of the plant according to the invention is that the flow rate of metal passing through it is very moderate compared to that flowing in an RH (10 t/min compared to 240 t/min). The refractories are therefore worn away substantially less quickly, in particular in the region of the dip tubes.

Instead of inserting this reactor 5 into a line for the continuous production of liquid metal 2, it is also possible to use it simply so as to transfer said metal from one receptacle initially containing a certain quantity of liquid steel (and not receiving any more of it subsequently) into another receptacle, ladle or tundish, which is initially empty. For this purpose, it is necessary however to arrange for the surface of the metal in the finish receptacle to always be at a lower height than that of the metal in the start receptacle. This may necessitate having to move these apparatuses with respect to each other during operation in a quite complicated manner and may require the start and finish receptacles to be shallow, so that they are not moved too greatly.

If the initial carbon content of the liquid steel is not very high on entering the reactor 5 (for example of the order of 80 ppm), a single reactor of reasonable size enables this content to be lowered to levels of the order of 5 ppm, as will be seen in the example described further on. If the initial carbon content is a few hundred ppm, it is possible to add an additional reactor to the reactor 5, which additional reactor is located upstream of the reactor 5 in the continuous production line and which would have the function of bringing the carbon content to the level required for entry into the reactor 5 (80 ppm in our example). Since, in a vacuum treatment, going from a carbon content of 200–800 ppm to a content of 80 ppm is very rapid, provided that the decarburization is assisted by a powerful injection of gas, a reactor having only a single thoroughly mixed cell (and therefore being much shorter than the reactor 5) would be sufficient for this use. A reactor having the configuration of a conventional RH, but in which the dip tubes each dip into a different receptacle, would be quite acceptable.

Figure 2:
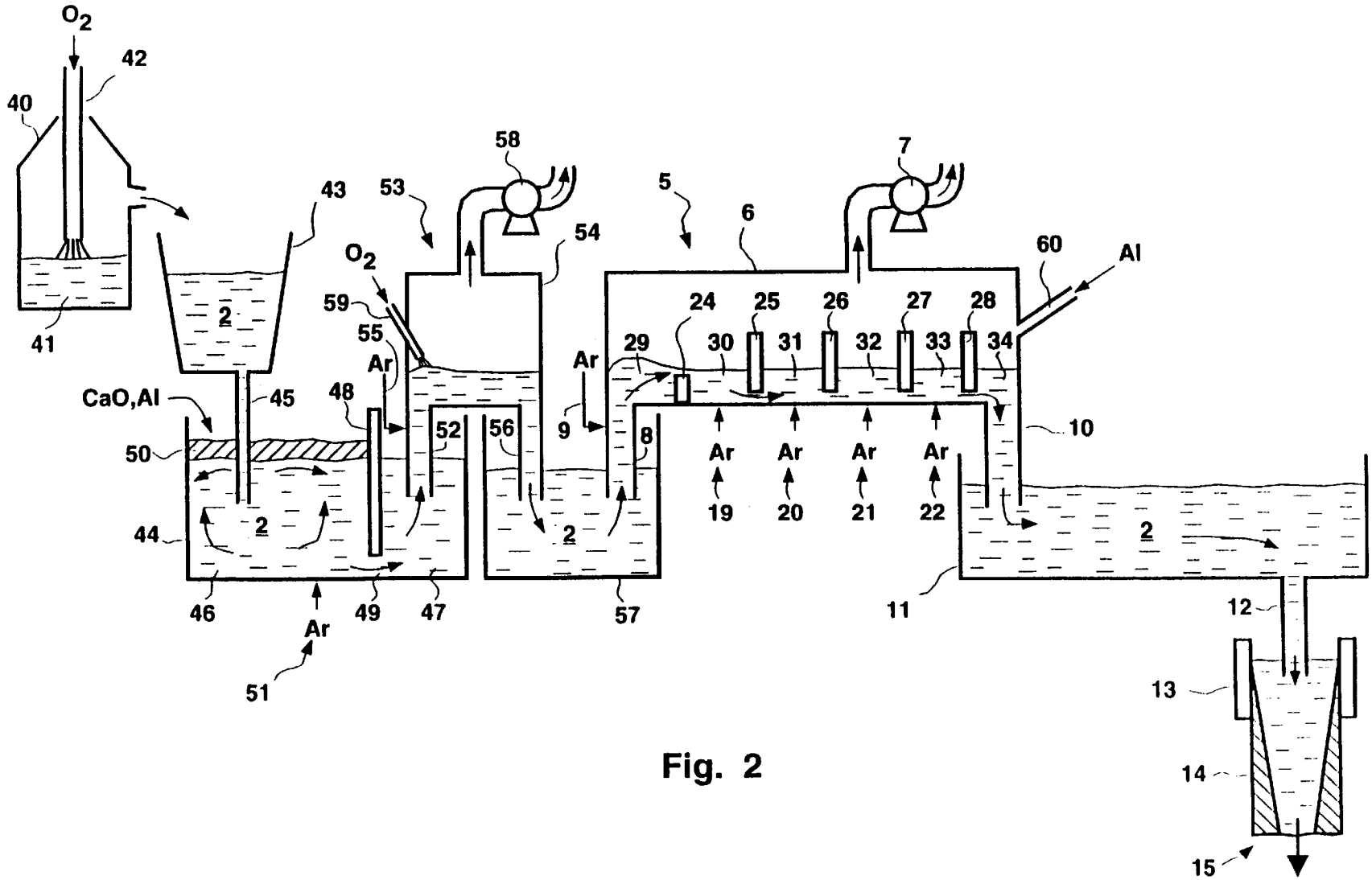
FIG. 2 shows diagrammatically an example of an entire line for producing and casting an ultra-low-carbon steel, into which a reactor according to the invention is inserted.

An example of a line for the continuous production and casting of a steel having an ultra-low content of carbon, or indeed of other elements such as sulfur, nitrogen and oxygen, will now be described. This example is shown in FIG. 2.

This production line firstly includes a primary smelting apparatus 40. Its function is to produce, continuously or discontinuously, a liquid steel whose composition has to be adjusted in the subsequent operations. This apparatus 40 may, as shown in FIG. 2, be a converter of the conventional LD type, that is to say in which the liquid pig iron introduced into it is converted into liquid steel by decarburization. This decarburization is obtained by blowing in oxygen by means of an emerged [sic] lance 42. However, any other known primary smelting apparatus may be suitable of course, for example a converter of the LWS type with oxygen blasting via the bottom, a converter with compound blasting, or an electric furnace producing liquid steel from scrap iron. This primary smelting apparatus 40 periodically feeds a large-size steelmaking ladle 43 with liquid steel 2, said ladle acting as a buffer receptacle. The contents of this ladle 43 are poured continuously into a first receptacle 44. The rate of flow feeding this first receptacle 44 is controlled by a slide-valve closure (not shown) of a type known per se (or its functional equivalent) fitted onto the ladle 43. The liquid steel 2 is introduced into the first receptacle 44 via a shroud tube 45 made of refractory, designed to limit the absorption of atmospheric oxygen and nitrogen through the stream of liquid metal. In the steady state, the flow rate of steel leaving the ladle 43 is, for example, around 10 t/min, corresponding to the average production rate of the smelting apparatus 40.

Various operations for adjusting the composition of the liquid steel 2 may take place in the first receptacle 44, in particular the addition of alloying elements and, above all, desulfurization. It is, in fact, advisable to carry out the desulfurization of the steel 2, when this is necessary, before the vacuum treatment. One reason for this is that this operation requires the addition of materials such as lime which may have a high moisture content. These materials are therefore likely to bring hydrogen into the liquid steel 2. In addition, the desulfurization requires an intense mixing of the liquid steel 2, which thus runs the risk of absorbing atmospheric nitrogen. It is therefore necessary for the degassing of the liquid steel 2 to follow the desulfurization in order to compensate for its negative effects on the dissolved-gas content. In addition, the removal of nitrogen during this degassing is easier the lower the sulfur content of the liquid steel 2.

Advantageously, the first receptacle 44 is divided into two compartments 46, 47 by a transverse partition 48, the lower part of which is furnished with one or more openings 49 providing communication between the two compartments. The first compartment 47 is that into which the liquid steel 2 from the ladle 43 is introduced, and in which the desulfurization takes place. For this purpose, conventional means for introducing solid matter (these means not being shown) make it possible always to maintain metallurgical conditions in this first compartment 47 which are favorable to the desulfurization of the metal, namely:

a very low content of oxygen dissolved in the liquid steel 2; it is obtained by periodically or continuously adding aluminum which combines with the dissolved oxygen in order to form alumina;

the presence on the surface of the liquid steel 2 of a layer of a slag 50 having a high lime content and a high fluidity, so as to make the lime react with the sulfur in the metal, which is then trapped in the slag in the form of CaS; it is necessary always to maintain a satisfactory composition for this slag, although it progressively becomes saturated with CaS as the operation continues and it progressively becomes enriched with alumina from the deoxidation; it is therefore necessary to remove a fraction of this slag periodically and, at the same time, to add lime (and possibly other constituents ensuring that the slag has the correct fluidity) in order to compensate for this removal.

The first compartment 46 is also equipped with means for mixing the liquid steel 2, such as means 51 for blowing in argon, making it possible to provide the intense mixing between the metal 2 and the slag 50, necessary for performing the desulfurization, and to remove a large part of the alumina inclusions formed when introducing the aluminum.

The sulfur content of the liquid steel 2, obtained following this treatment, also depends on the sulfur content of the raw materials from which it has been smelted, on the quantity of slag 50 lying on top of the liquid steel 2 and on the mean residence time of the liquid steel 2 in this first compartment 46. The capacity and geometry of this first compartment 46 must therefore be calculated to guarantee that the liquid steel 2 has a mean residence time which is high enough for the sulfur content to reach the desired level.

Virtually only liquid steel 2 free of sulfur and stripped of a large part of the alumina inclusions formed in the first compartment 46 therefore enters the second compartment 47 of the first receptacle 44. It is into this second compartment 47 that the lower end of the ascending dip tube 52 of a rough decarburization reactor 53 dips. This reactor 53 has, in the example shown, a configuration quite similar to that of a conventional RH. It includes a cylindrical vessel 54 provided with two dip tubes, namely said ascending dip tube 52 which may be equipped with a device 55 for injecting argon and a descending dip tube 56 whose lower end dips into an intermediate receptacle 57 separate from the first receptacle 44. The vessel 54 is equipped with a gas-sucking device 58 making it possible to maintain a reduced pressure in the reactor 53, for example of the order of 50 torr or less, under the effect of which reduced pressure the liquid metal 2 is sucked into the vessel 54. The gas blown possibly into the ascending dip tube 55 contributes to making the metal 2 flow between the first receptacle 44 and the intermediate receptacle 57, with a flow rate which, in the steady state, is substantially equal to the rate of flow feeding the first receptacle 44. Steady operating conditions are thus maintained in the entire plant if it is contrived to keep a constant difference in level between the surfaces of the metal in the first receptacle 44 and the intermediate receptacle 57. If argon is not blown into the ascending dip tube 52, it is, however, necessary to blow it into the vessel 54 itself in order to speed up the decarburization of the metal 2. The vessel 54 of the reactor 53 is equipped with a lance 59 (or with an equivalent device) making it possible for oxygen to be blown into the liquid metal, preferably in a zone located in line with the ascending dip tube 52. The oxygen thus introduced, on the one hand, consumes the aluminum present in the bath and, on the other hand, is dissolved in the steel 2 where it can thus be combined with the carbon in order to carry out the required rough decarburization. This has to bring the carbon content of the metal 2 down from 200–800 ppm to, for example, about 80 ppm. Since the decarburization is very rapid in this range of contents, this thoroughly mixed reactor 53 is sufficient to obtain this result.

On leaving the reactor 53, the liquid steel 2 has therefore a carbon content which is already markedly less than its initial content, and contains sufficient dissolved oxygen for the decarburization to be able to continue down to an ultra-low content if it is treated in a reactor of the type shown in FIG. 1. Such a treatment constitutes the next step in the production line.

For this purpose, the liquid steel 2 is removed from the intermediate receptacle 57 via a high decarburization reactor 5, identical to the one described previously and shown in FIG. 1. For this reason, it is not necessary to describe it in more detail here. In this case, the intermediate receptacle 57 fulfills the functions of the intermediate receptacle 4 in FIG. 1. The other elements common to the two plants are designated in FIG. 2 by the same reference symbols as in FIG. 1. Means 60 have been added to it for the continuous addition of alloying elements to the liquid steel 2, such as aluminum, silicon and manganese, into the final cell or cells of the high decarburization reactor 5. At this stage, the decarburization is considered to be complete and the metal may finally be made to grade after the residual dissolved oxygen has been captured by the aluminum.

As in the plant described previously, shown in FIG. 1, the liquid steel 2, which is decarburized and made to grade, enters a continuous casting tundish 11 into which the descending dip tube 10 of the high decarburization reactor 5 is submerged. It then starts to solidify in the mold or molds 13 in order to form, in each of them, a slab, bloom or billet 15. This tundish 11 is preferably equipped with all the known improvements which make it possible to cast products of high metallurgical quality, especially from the point of view of being free of inclusions: obstacles which increase the residence time of the metal, mixing devices using the blowing-in of gas or using induction, a cover which sits over the tundish and under which is blown in inert gas, etc. These devices are particularly useful here insofar as the final deoxidation of the metal 2 is in this case carried out just for its entry into the tundish, and it is therefore essential to remove the inclusions resulting from this deoxidation rapidly. Moreover, the presence in the tundish 11 of a device for reheating the metal, by induction or by a plasma torch, as is hereafter well known, is recommended. The reason for this is that the numerous transfer operations undergone by the liquid metal 2 during its treatment are expensive in terms of heat, especially when the plant has not yet reached its complete thermal equilibrium. The possibility of reheating the metal 2 at various stages in its treatment therefore avoids pouring it from the smelting apparatus 40 at too high a temperature, which would shorten the duration of use of its refractory lining. Such reheating is also one of the functions of the combustion of aluminum by injection of oxygen into the rough decarburization reactor 53.

Advantageously, the metallurgical receptacles 43, 44, 57 are furnished with covers and with means for blowing in an inert gas under these covers (not shown) in order to limit the contact of the liquid metal with ambient air.

By way of example, the following production scheme, intended to produce a steel having a carbon content of the order of 5 ppm, may be imagined:

smelting a steel having a carbon content of about 400 to 800 ppm in the 300 t capacity converter 40 at a rate of one pouring every 30 minutes (that is, an average production rate of 10 t/min); pouring the metal 2 into the ladle 43;

continuously transferring, at a flow rate of 10 t/min, the liquid metal 2 into the first compartment 46 of the first receptacle 44 where it is deoxidized and desulfurized;

sucking the deoxidized and desulfurized liquid metal 2 from the second compartment 47 of the first receptacle 44 into the rough decarburization reactor 53, with a flow rate of 10 t/min; oxidizing, in this reactor 53, all the aluminum and part of the carbon which are present in the metal 2; characteristics of the reactor 53 are: capacity of the vessel: 15 t of liquid metal, representing a mean residence time of the metal 2 of 90 sec; pressure: 50 torr; flow rate of argon into the ascending dip tube 52 or the vessel 54: 60 to 65 1/sec; these conditions lead to the formation, on leaving the rough decarburization reactor 53, of a metal 2, containing about 80 ppm of carbon and 160 ppm of dissolved oxygen, which passes into the intermediate receptacle 57;

sucking the liquid metal 2 from the intermediate receptacle 57 into the high decarburization reactor 5, with a flow rate of 10 t/min; this reactor 5 has the following characteristics: length: 9 m; width: 1 m; average depth "e" of the metal 2: 40–45 cm; working pressure: 50 torr, or even less; number of cells: 9, including the first cell 29 into which emerges the ascending dip tube 8; the final cell of these cells is devoted to making to grade and does not participate in the decarburization if deoxidizing elements (aluminum, silicon, etc.) and other alloying elements are added thereto; length of the first cell 29: 1.8 m; length of the other cells: 0.9 m; flow rate of argon in each cell: about 15 1/sec; mean residence time of the metal in each cell: 15 sec, except in the first cell 29 where it is 30 sec, hence an overall residence time of 150 sec in the reactor; carbon content in the first cell: 30 ppm; carbon content in the 8th and 9th cells: 5 ppm;

introducing the decarburized, deoxidized and made-to-grade liquid metal 2 into the tundish 11;

pouring the metal 2 into the molds 13 in order to form ferrometallurgical products 15.

Compared to a conventional RH having the same production rate, it is therefore possible, in this example, to multiply by 8 the time during which a portion of metal is exposed to the vacuum and is able to be decarburized, if the residence time of the metal 2 in the rough decarburization reactor 53 and in the reactor 5 according to the invention are added together.

The ultra-low-carbon contents obtained often go hand in hand with very low nitrogen contents (30 ppm and less), on condition that the nitrogen content on leaving the smelting apparatus 40 is not too high and that the following steps (especially the transfer from one receptacle to another and the mixing of the metal) do not result in consequent uptakes of nitrogen. Should it be desired to lower the nitrogen content as much as possible, the above operating mode would not be optimal. The reason for this is that there would be very little denitriding in the final cells since the highly decarburized metal would have a high content of dissolved oxygen. The sweeping with the CO produced by decarburization would therefore be too small there to be able to counterbalance the negative effect of the dissolved oxygen on the denitriding kinetics.

It is therefore possible to increase the flow rate of argon into the first cells of the high decarburization reactor 5 and/or to replace the argon with hydrogen in order to accelerate the decarburization kinetics and to obtain the intended carbon content earlier than in the previous practice.

Next, deoxidizing aluminum is added, not in the very final cell but further upstream. The final cells may thus be devoted to denitriding, by blowing therein a large volume of gas (argon or hydrogen) into the deoxidized metal.

Moreover, as stated earlier, it is possible to use the reactor 5 no longer as a high decarburization reactor but as a reactor for the vacuum deoxidation of the metal using carbon. The advantage of this is that a final metal is obtained which has a very low included-oxygen content since a minimum amount of aluminum is necessary for the final deoxidation of the liquid metal. For this purpose, in the above production scheme, the carbon content of 80 ppm (for example), obtained by virtue of the rough decarburization reactor 53, may be acceptable. In the reactor 5 according to the invention, the various injections of argon are replaced with injections of a liquid or gaseous hydrocarbon such as methane, $CH_4$, which decomposes by cracking into carbon and hydrogen. The carbon combines with the oxygen dissolved in the metal 2 to form CO, the formation kinetics of which is speeded up by hydrogen. It is also possible to modulate, in each cell, the quantity of hydrocarbon injected in order for the carbon content in the bath to remain constant as deoxidation progresses. It is thus possible to obtain a dissolved-oxygen content of about 10 ppm while at the same time keeping the initial 80 ppm carbon contents.

Finally, it is conceivable to obtain at the same time an ultra-low carbon content (5 ppm) and an ultra-low dissolved-oxygen content (10 ppm). To do this, it is necessary to reduce the pressure in the reactor to 10 torr or less, so as to decrease the oxygen content in thermodynamic equilibrium with a given carbon content.

As a variant of the production line which has just been described, it is conceivable to replace the primary smelting apparatus 40 and the ladle 43 with a primary smelting apparatus which would operate continuously. This would continuously pour liquid metal directly into the first receptacle 44, with a flow rate substantially equal to the flow rate of the liquid metal in the plant.

Of course, the invention is not limited to the examples which have just been described and shown, it being possible to make modifications to the setup of the metallurgical reactor according to the invention and to the liquid-steel production process which employs it. The essential point is that the general principle governing the design of the reactor, namely a flow of liquid metal within it which is as close as possible to the ideal case of plug flow, shall be preserved. It is possible, for example, to use a cascade of reactors according to the invention. Likewise, it is clear that the reactor which has been described can without any problem also be used for the production of steels which do not have a particularly low carbon content but which are desired only to be significantly free of inclusions and to have a low dissolved-gas content. Finally, the invention may find applications in the production of metals other than steel.

We claim:

1. A process for adjusting the composition of a liquid metal in a reactor that is divided into a plurality of cells, each of which defines a mixing zone, and each of which includes a fluid injector for thoroughly mixing liquid metal in the zone defined by the cell, comprising the steps of sucking up said liquid metal from a start receptacle into a reactor which is at a reduced pressure with respect to said start receptacle, making said metal to flow inside said reactor through each of said mixing zones defined by said plurality of cells under conditions close to plug flow to undergo a metallurgical treatment and then, after it has been conveyed through said reactor, discharging said metal into a finish receptacle with respect to which said reactor is also at a reduced pressure.

2. The process as claimed in claim 1, wherein said start receptacle is fed continuously with liquid metal and wherein all of said metal in said reactor is also made to flow continuously into said finish receptacle without recirculation back into said start receptacle.

3. The process as claimed in claim 2, wherein said finish receptacle is a continuous casting tundish.

4. The process as claimed in claim 1, wherein said liquid metal is steel and wherein said metallurgical treatment includes decarburization.

5. The process as claimed in in claim 1, wherein said liquid metal is steel and wherein said metallurgical treatment includes denitriding.

6. The process as claimed in claim 1, wherein said liquid metal is steel and wherein said metallurgical treatment includes a vacuum deoxidation using carbon.

7. The process as claimed in claim 1, further comprising the step of agitating said liquid metal in said mixing zones by injecting argon into said liquid metal from said fluid injector.

8. The process as claimed in claim 1, further comprising the step of agitating said liquid metal in said mixing zones by injecting a hydrocarbon into said liquid metal from said fluid injector.

9. The process as claimed in claim 1, further comprising the step of agitating said liquid metal in said mixing zones by injecting hydrogen into said liquid metal from said fluid injector.

10. A plant for adjusting the composition of a liquid metal, which includes a start receptacle for containing said liquid metal, a reactor and a finish receptacle, said reactor including a vessel provided with means enabling its interior to be maintained at a reduced pressure with respect to those pressures existing in said start receptacle and said finish receptacle, with a first ascending dip tube, for dipping into the liquid metal contained in said start receptacle and the other end of which is connected to the bottom of said vessel, and a second descending dip tube, for dipping into the liquid metal contained in said finish receptacle and the other end of which is connected to the bottom of said vessel, and said vessel being shaped so as to impose on said liquid metal a flow close to plug flow over its travel between said dip tubes, wherein said vessel includes dams for dividing its interior into a plurality of cells while still allowing communication between cells, and each cell defines a mixing zone, and wherein each cell includes an agitating means including means for injecting a fluid into liquid metal.

11. The plant as claimed in claim 10, wherein the vessel has an approximately rectangular cross section and wherein the ratio between the distance separating the dip tubes and the width of the vessel is at least equal to 6.

12. The plant as claimed in claim 10, wherein said agitating means include means for applying moving electromagnetic fields to said liquid metal.

13. The plant as claimed in claim 10, wherein said means for ensuring continuous flow of said liquid metal between said start receptacle and said finish receptacle include means for injecting a gas into the liquid metal contained in said ascending dip tube.

14. The plant as claimed in claim 10, which includes means for continuously feeding said start receptacle with liquid metal and means for continuously extracting the liquid metal from said finish receptacle.

15. The plant as claimed in claim 14, wherein said finish receptacle is a continuous casting tundish.

16. The plant as claimed in claim 10, further comprising:

an apparatus for the primary smelting of the liquid metal;

means for continuously pouring said liquid metal from the primary smelting apparatus into a first receptacle provided with means for introducing deoxidizing agents into the liquid metal and with mixing means; and a second reactor for the rough decarbonization of the liquid metal, including a vessel provided with means for putting said liquid metal at a reduced pressure, with a first dip tube dipping into the liquid metal contained in said first receptacle and with a second dip tube dipping into an intermediate receptacle, said second reactor vessel also including means for blowing oxygen into said liquid metal.

17. The plant as claimed in claim 16, wherein said primary smelting apparatus itself forms said means for continuously pouring said liquid steel onto said first receptacle.

18. The plant as claimed in claim 16, wherein said first receptacle includes a partition separating it into two communicating compartments, wherein one of these compartments receives just said liquid metal coming from said means, which pour it into said first receptacle, and said deoxidizing agents and wherein said first dip tube of said rough decarburization reactor dips into the other compartment.

19. The plant as claimed in claim 16, wherein said means for ensuring continuous flow of said liquid metal between said first receptacle and said intermediate receptacle include means for blowing a gas into the liquid metal contained in said first dip tube.

* * * * *